US005606354A

United States Patent [19]

Bekki et al.

[11] Patent Number: 5,606,354

[45] Date of Patent: Feb. 25, 1997

[54] RECOVERY MECHANISM FOR ADJUSTABLE INK JET HEAD

[75] Inventors: Toshihiko Bekki, Kawasaki; Tsutomu Kawai, Yokohama; Hideo Fukazawa, Chigasaki; Atsushi Arai, Kawasaki, all of Japan

[73] Assignee: Canon Kabushiki Kaisha, Tokyo, Japan

[21] Appl. No.: 269,754

[22] Filed: Jul. 1, 1994

[30] Foreign Application Priority Data

Jul. 6, 1993 [JP] Japan ..... 5-191993
Jul. 27, 1993 [JP] Japan ..... 5-184867

[51] Int. Cl.[6] ..... B41J 2/165
[52] U.S. Cl. ..... 347/33; 347/8
[58] Field of Search ..... 347/33, 8; 400/55, 400/58

[56] References Cited

U.S. PATENT DOCUMENTS 4,719,475 1/1988 Kiyohara et al. ..... 346/140 R
4,760,409 7/1988 Kiyohara et al. ..... 346/140 R
4,959,673 9/1990 Noda ..... 347/33
5,113,206 5/1992 Fukazawa ..... 346/140 R
5,126,765 6/1992 Nakamura ..... 346/140 R
5,164,748 11/1992 Katayanagi et al. ..... 346/140 R
5,479,194 12/1995 Hirano et al. ..... 347/22

FOREIGN PATENT DOCUMENTS 0562118 9/1993 European Pat. Off. ..... 347/33
3246052 11/1991 Japan ..... 347/33
4278358 10/1992 Japan ..... 347/33

*Primary Examiner*—John E. Barlow, Jr.
*Attorney, Agent, or Firm*—Fitzpatrick, Cella, Harper & Scinto

[57] ABSTRACT

A recovering mechanism includes a cleaning member for cleaning a discharge surface of an adjustable ink jet head and an inclination adjusting mechanism for adjusting an inclination of the cleaning member to match an inclination of a discharge surface of the ink jet head.

12 Claims, 7 Drawing Sheets

FIG. 5(a)1
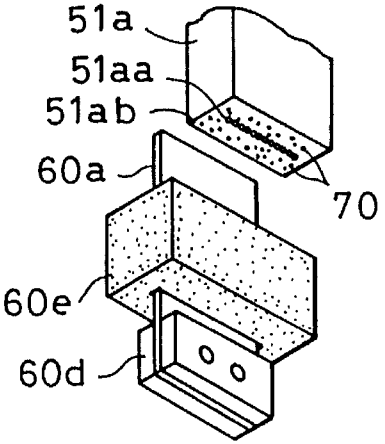
FIG. 5(b)1
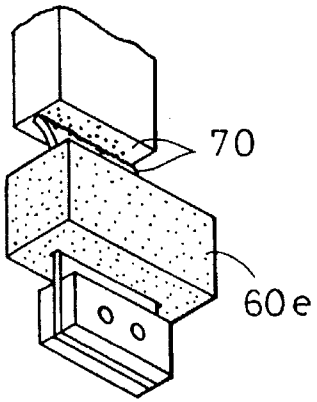
FIG. 5(c)1
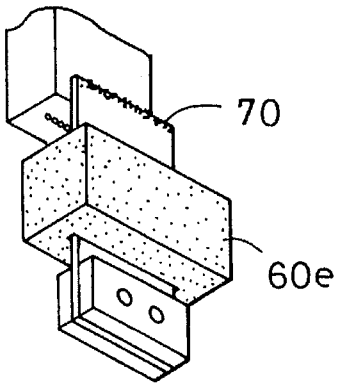
FIG. 5(d)1
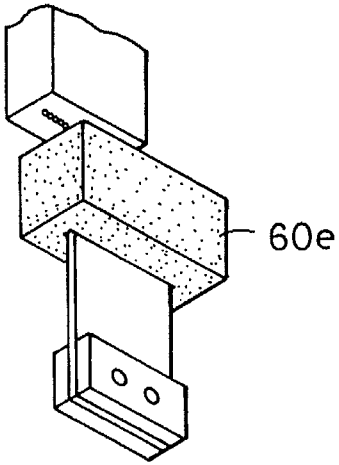
FIG. 5(a)2
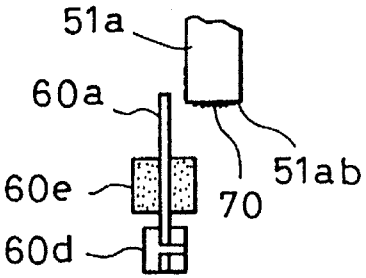
FIG. 5(b)2
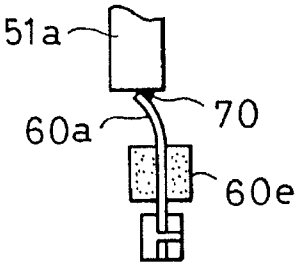
FIG. 5(c)2
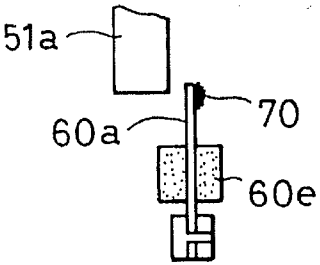
FIG. 5(d)2
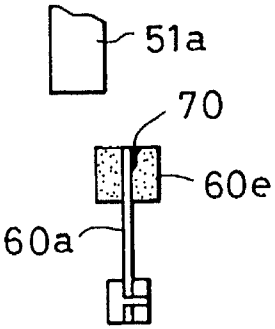

51a
51ab
70
63
62
64
65

51a
70
62

51a
70
62

51a
70
62

RECOVERY MECHANISM FOR ADJUSTABLE INK JET HEAD

BACKGROUND OF THE INVENTION

1. Field of the Invention

The present invention relates to a recovery mechanism for removing foreign matter from an ink discharge surface of a recording head, more particularly, to an improved recovery mechanism capable of reliable cleaning of a recording head that can be adjusted.

2. Description of the Related Art

In an ink jet recording system in which recorded images are formed by discharging ink onto a recording medium, an ink discharge means typically incorporates electro-thermal transducers or electro-mechanical transducers to apply discharge pressure to the ink.

In the ink discharge means (also referred to herein as an ink jet head), ink droplets or foreign matter, such as dust containing, for example, paper powder, can become attached to an ink discharge surface having therein ink discharge ports during the discharge of ink in an image recording operation.

Such attached objects may cause ink discharge failure, for example, by varying the direction in which the discharged ink travels, or by entering and thereby clogging the ink discharge ports, thus causing deterioration of the recording characteristics.

Conventionally, such a discharge failure is improved or recovered by wiping the ink discharge surface using an elastic sheet or blade made of a flexible material such as rubber to serve as discharge-recovery means for performing what is known as a wiping operation. Such a blade may be retractable relative to a scanning area scanned with the ink jet head mounted on a carriage so that the blade can protrude into the scanning area of the carriage to wipe the ink discharge surface while the carriage is being scanned. Alternatively, the blade may be brought into abutment with and made to slide against the ink jet head.

FIG. 1 is a perspective view showing the schematic structure of an example of a conventional ink jet apparatus. A carriage 2 carrying an ink jet head 1 is moved back and forth along a slide base 4 and a slide shaft 3 by a driving force of a motor 5, which driving force is transmitted to the carriage 2 via a belt 9.

A recovery unit 10 for recovering from a discharge failure of the ink jet head 1, that is, for recovering ink discharge, is fixed outside an end of a printing surface 1A (recording area) faced by the ink discharge surface of the ink jet head 1. The recovery unit 10 includes a blade 12 for cleaning the discharge surface of the ink jet head 1, and a cap 11 for receiving ink discharged from the discharge port or for protecting the ink jet head 1 when recording is suspended.

FIG. 2 is a schematic perspective view of the recovery unit 10. Reference numeral 13 denotes a recovery unit base constituting an outer shell of the unit. A suction recovery operation is performed on the head by drawing ink from the discharge port of the ink jet head by means of a negative pressure of a pump (not shown) driven when the ink jet head is capped. Capping is performed by a driving motor (not shown), a gear group (not shown) and an eccentric cam (not shown), which are provided at the distal end of the driving motor that move the cap 11 toward or away from the head.

A blade cam 6 is rotated about a shaft 7 by the driving force of the driving motor. Reference numeral 21 denotes a blade base which is slidable in a straight line toward the head 1 along the side surface of the base 13. The blade base 21 is urged in a direction in which it is separated from the head by means of a tension spring 23. A blade lever 29 slides against the blade cam 6, whereby cam-shaped irregularities are transmitted in the form of a reciprocative movement of the blade base 21. The blade 12 is mounted on a distal end of the blade base 21. Between the cap 11 and the blade 12 there is a rubbing member 14 for rubbing the discharge port surface of the ink jet head 1 to remove any substance attached thereto.

The amount of reciprocative movement of the blade 12 is determined by the irregularities of the blade cam 20, that is, the optimum value for the normal recording scanning position of the ink jet head 1 is set. However, in recent years, recording apparatuses have been improved in such a manner that they can perform recording on various types of recording media. When printing is performed on, for example, a sheet of thick paper, the head is moved together with the carriage to account for the thicker recording medium. In such a case, the position of the head relative to the blade will vary, and the amount the blade projects onto the head during cleaning differs between the upper and lower portions of the head, thus affecting the blade's wiping performance.

SUMMARY OF THE INVENTION

In view of the aforementioned problem of the prior art, a primary object of the present invention is to provide a recovery mechanism which is capable of excellent cleaning even when the distance between a head and a recording medium is adjusted according to the type of recording medium, and an apparatus incorporating such a recovery mechanism.

In accordance with one aspect of the present invention, a recovering mechanism for use with an ink jet head mounted to a recording apparatus at an adjustable inclination comprises a cleaning member for contacting a discharge surface of the ink jet head to recover satisfactory liquid discharge therefrom, and an inclination adjusting mechanism for matching an inclination of the cleaning member to the inclination of the discharge surface.

BRIEF DESCRIPTION OF THE DRAWINGS

FIGS. 5$(a)_1$, 5$(a)_2$, 5$(b)_1$, 5$(b)_2$, 5$(c)_1$, 5$(c)_2$, 5$(d)_1$ and 5$(d)_2$ illustrate example of a cleaning operation performed by a cleaning blade according to one embodiment of the present invention;

DETAILED DESCRIPTION OF THE PREFERRED EMBODIMENTS

Figure 3:
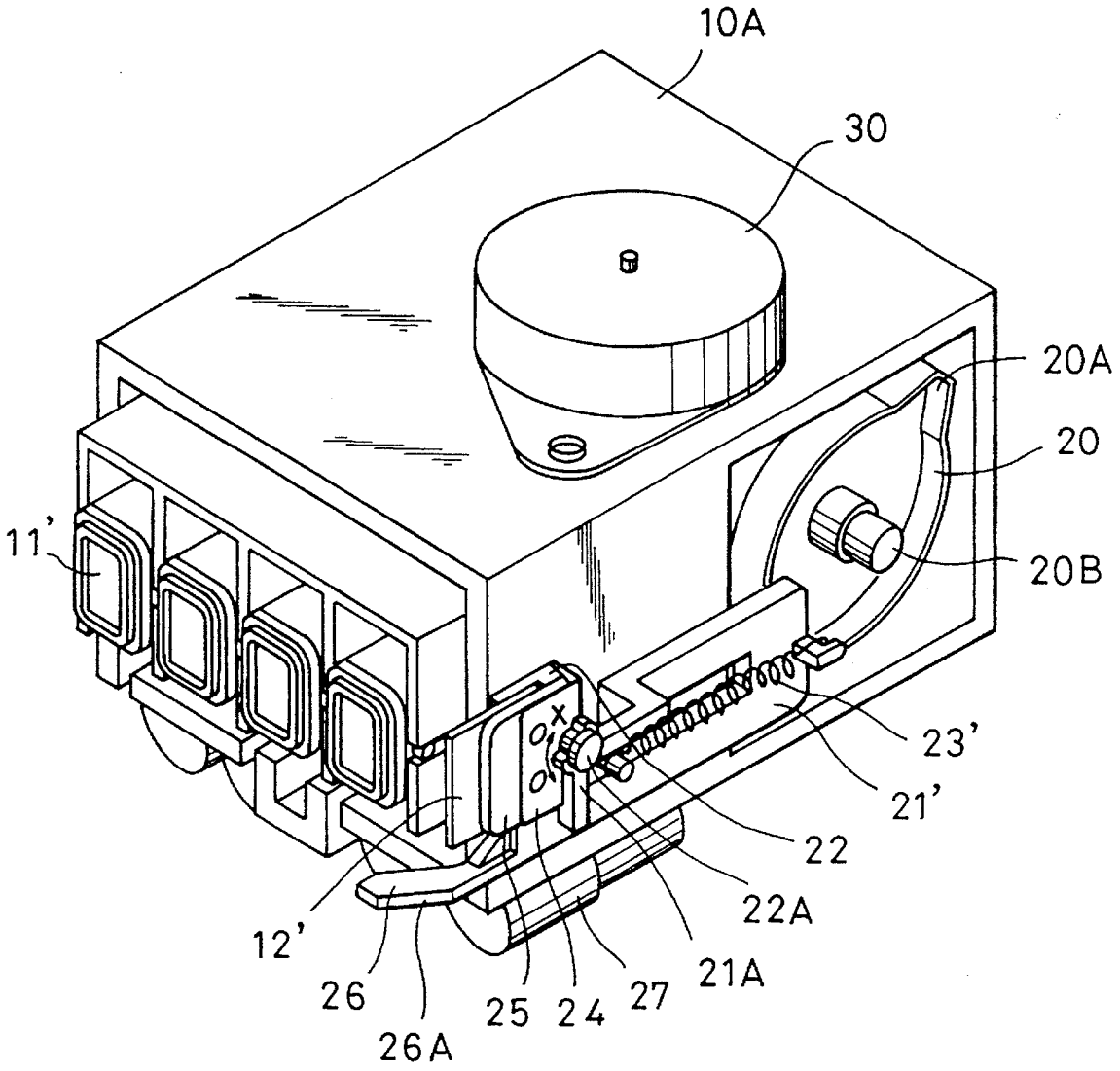
FIG. 3 is a perspective view of an embodiment of a recovery unit according to the present invention.

FIG. 3 is a perspective view of a discharge recovering mechanism of an apparatus to which the present invention is applied. In the figure, a recovery unit base 10A serves as an outer shell of a unit for recovering the head. A head recovery operation is performed using a negative pressure of a pump 27 driven when caps 11' are moved reciprocatively relative to the heads by a driving motor 30, a worm gear (not shown), a worm wheel (not shown) and an eccentric cam (not shown).

Reference numeral 20 denotes a blade cam which is rotatable around a shaft 20B via gears by the drive of the driving motor 30. Reference numeral 21' denotes a blade support base which is incorporated in such a manner as to be slidable linearly toward the head along the side surface of the recovery unit base 10A. The base 21' is urged toward the direction in which it is moved close to the head by means of a spring 23'. A boss (not shown) which slides along an inner surface of the blade cam 20 is provided at an end portion of the support base 21'. When the boss comes into contact with a maximum radius portion 20A of the blade cam 20, the support base 21' advances toward the head by the force of the spring 23'.

An arm 26 on a blade bracket 22 abuts directly against the carriage 2 to regulate the amount the blade projects. The arm 26 has an inclined portion 26A which is inclined at an angle of 45° relative to the direction in which the carriage 2 is scanned so that the arm can smoothly abut against the carriage when the carriage moves in a direction perpendicular to the direction of the movement of the support base 21'. If the arm can otherwise smoothly abut against the carriage, it is not necessary for the arm to have the inclined portion. The spring 23' urges the support base 21' at a force which allows the support base 21' to retract when the carriage abuts against the inclined portion 26A.

A blade 12' and an absorbing member 25 are sandwiched by the blade bracket 22 and a blade holder 24 comprising a plate spring. The blade bracket 22 has a rotary shaft 22A which is mounted in a rotary frame 21A of the support base 21', whereby the blade 12' is made rotatable about the rotary shaft 22A in a direction indicated by arrows X (in a vertical direction).

Normally, the gap between the head and recording medium is narrow for generally employed recording media, while it is increased for thick paper, such as postcards or envelopes.

Figure 1:
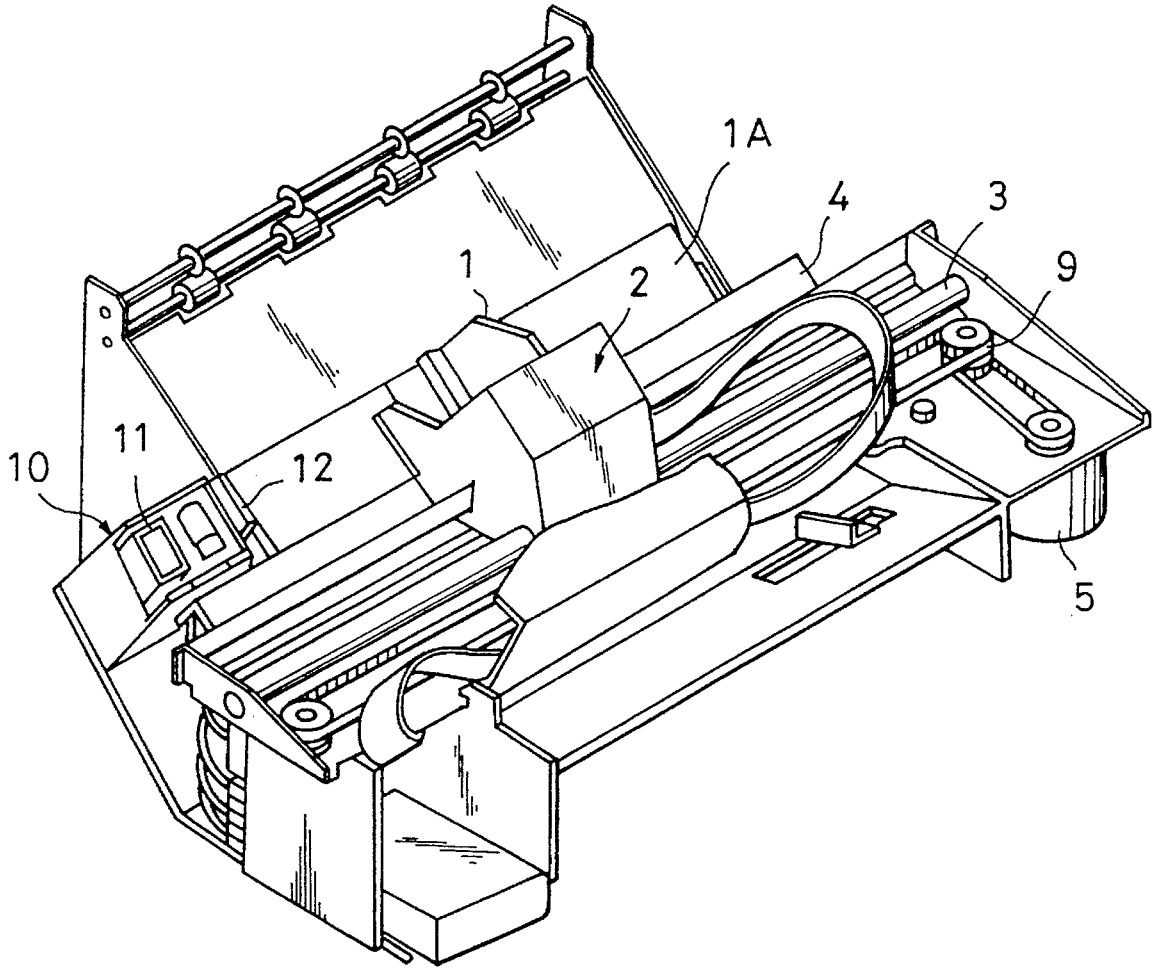
FIG. 1 PRIOR ART
FIG. 1 is a perspective view of a conventional ink jet recording apparatus.
Figure 2:
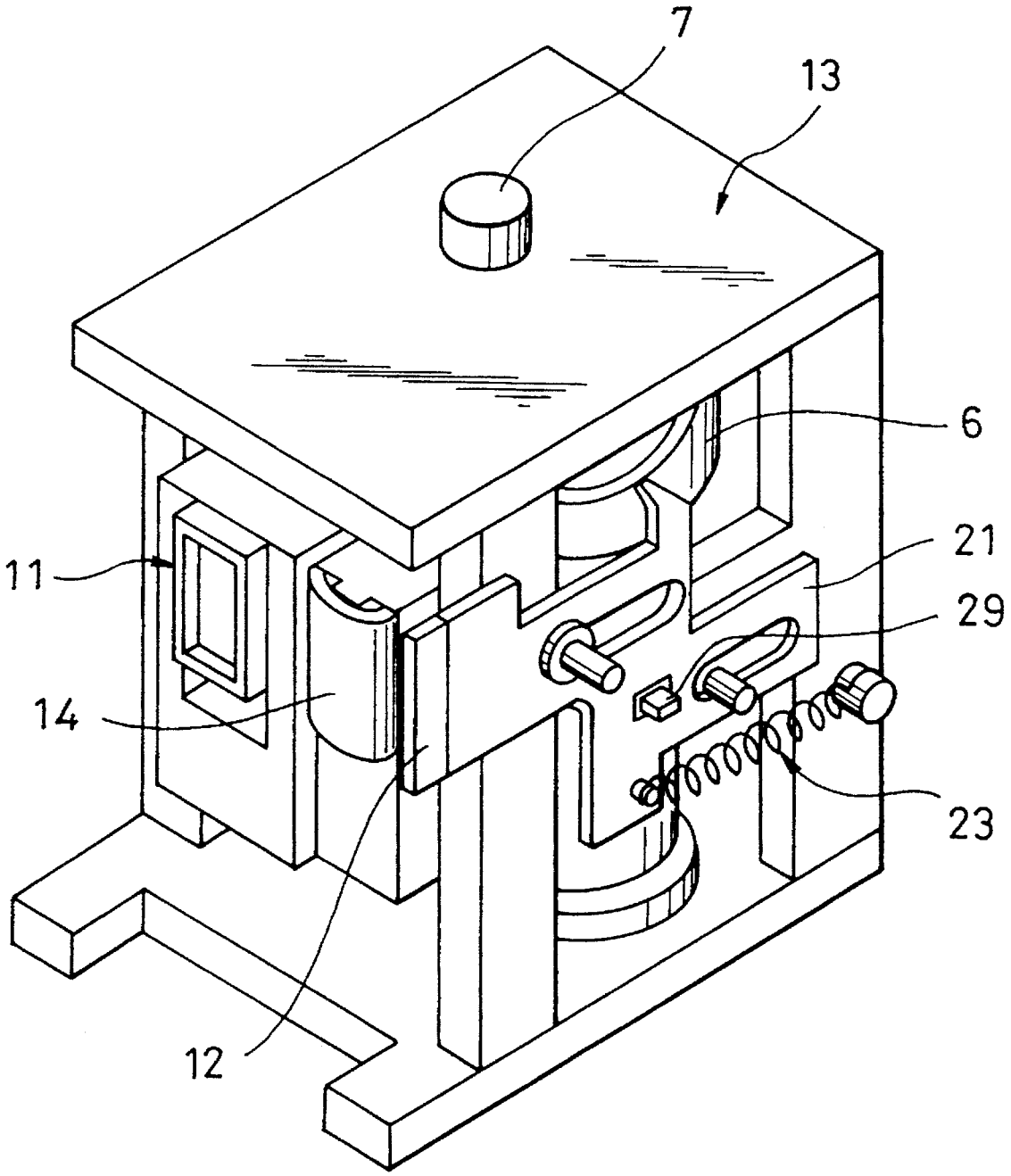
FIG. 2 PRIOR ART
FIG. 2 is a perspective view of a conventional recovery unit.

Referring to FIG. 1, the gap between the head and the paper is adjusted by slightly moving the slide shaft 3 downward using, as a center, a contact of the lower portion of the carriage with the slide base 4, thereby rotating the carriage about that contact. Thus, the head is rotated slightly upwardly and rearwardly from its initial position, thereby increasing the gap between the head and the paper.

When the gap between the head and the paper is increased by the above-mentioned adjustment, the distance between upper nozzles in the head and a recording surface 1A may be different from the distance between lower nozzles and the recording surface 1A if the nozzles are arranged in a vertically elongated array in the discharge surface. However, since the amount of movement of the head is small, this difference does not adversely affect recording.

When the gap between the head and the paper is varied by the above adjustment according to the thickness of the recording medium, and the recording inclination is changed, the distance between the upper and lower portions of the head and the blade also differs. Thus, the blade performs cleaning differently on the upper and lower portions of the head discharge surface. However, since the blade 12 is rotatable about the rotary shaft 22A, the blade 12, being a flexible, elastic material, will tend to seek a position in which it bears with equal pressure across the discharge surface from top to bottom.

When the blade is rotatable, even if the gap between the head and the recording medium is adjusted by pivoting the recording head, the angle between the carriage and the blade can be maintained to a fixed value and the amount by which the blade intersects the head discharge surface can thus be made the same across the head from its upper to its lower portions, without requiring a complicated structure and while maintaining in a fixed position the recovering device holding the blade.

Figure 4:
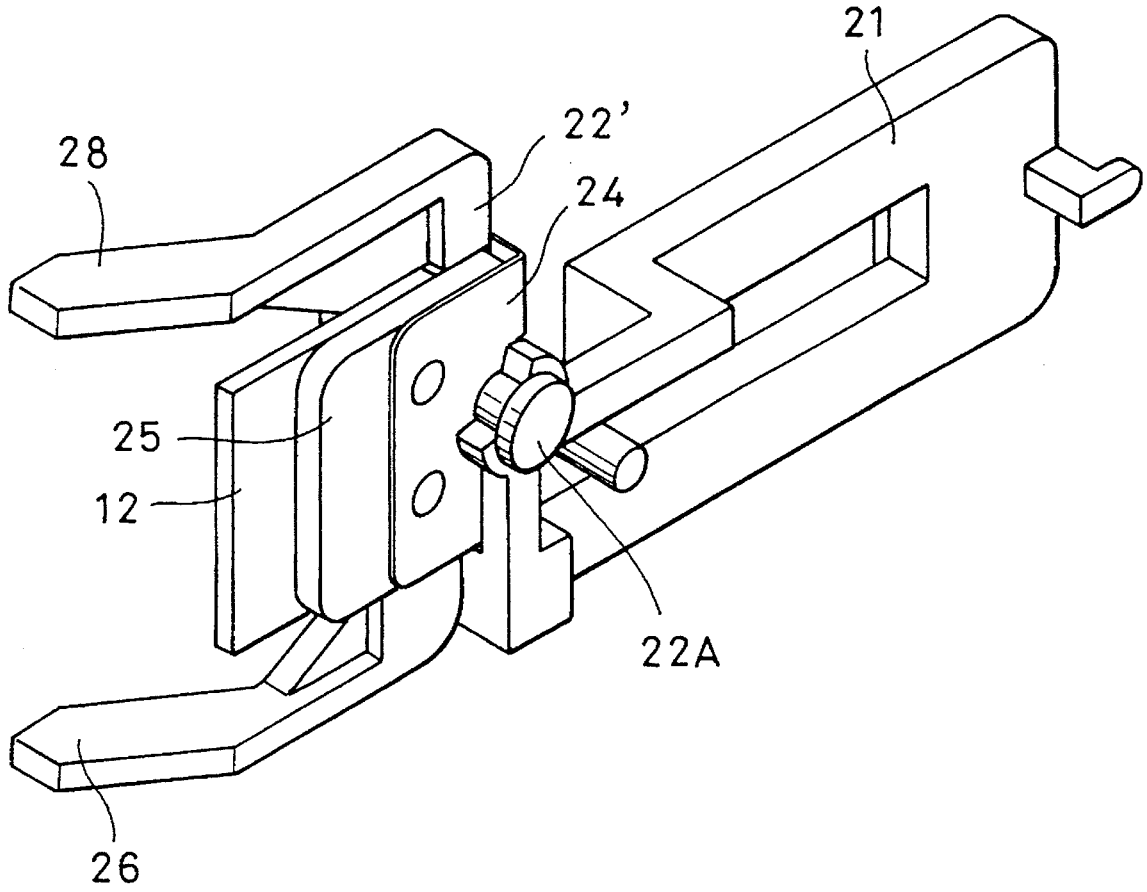
FIG. 4 is a perspective view of a blade retaining portion in the recovery unit according to another embodiment of the present invention.

FIG. 4 shows another embodiment of the blade retaining portion. In the figure, another arm 28 on a blade bracket 22' forms a second carriage contact portion along with the carriage contact portion provided by the arm 26. In this way, the angle of the blade can be more positively matched to the angle of the carriage and head discharge surface, thus ensuring that the amount the blade intersects the head discharge surface is the same at the upper and lower portions thereof. Consequently, the angle at which the blade intersects the head discharge surface can be matched even more reliably as compared with the case of the first-described embodiment shown in FIG. 3, and the amount by which the blade intersects the discharge surface can thus be more positively matched between the upper and lower portions of the discharge surface.

As will be understood from the foregoing description, in the apparatus according to the present invention, when the angle of the head or the carriage on which the head is mounted changes, the angle at which the blade wipes the head can be maintained at a desired value, thus improving the head wiping performance of the blade.

The ink attached to the blade during cleaning can become viscous if left on the blade, thus causing a problem in a subsequent wiping operation.

Conventionally, this is overcome by cleaning the blade with a porous, absorbent cleaning device used to rub the blade in an area adjacent to the head. However, in such an arrangement, the carriage scanning area must be made longer to allow the blade to be cleaned, and ink may scatter from the blade if it abruptly separates from the head after cleaning.

A recovery mechanism, having a structure which can overcome the above-described problems in addition to the aforementioned structure which allows the blade to follow the inclination of the head, will now be described.

The following description focuses only on the blade portion.

FIGS. 5(*a*), 5(*b*), 5(*c*) and 5(*d*) are schematic views showing the sequence of operation of an arrangement according to one embodiment of the present invention. The upper illustrations of the figures are perspective views, and the lower illustrations are cross-sectional views corresponding to the respective upper illustrations.

In FIG. 5, reference numeral 51*a* denotes an ink jet recording head. Reference numeral 51*aa* denotes discharge ports for discharging ink droplets. Reference numeral 51*ab* denotes a discharge surface (a face) in which the discharge ports 51*aa* are formed in a predetermined array. Reference numeral 60*a* denotes a blade of an elastic material, such as rubber or soft plastic. The blade 60*a* is supported by a blade holder 60*d*. The blade 60*a* is moved in a vertical direction as viewed in FIG. 5 by a driving device which is not shown. Reference numeral 60*e* denotes an absorbing member through which the blade 60*a* passes with a small gap therebetween so that it can move up and down. The absorbing member 60*e* is fixed to a recovery system.

In FIG. 5, reference numeral 70 denotes ink droplets or dust particles attached to the discharge port surface 51*ab* of the ink jet recording head 51*a*. Wiping of the discharge port surface 51*ab* is performed by moving the discharge port surface 51*ab* relative to the blade 60*a* in the sequence FIGS. 5(*a*)→5(*b*)→5(*c*)→5(*d*). FIG. 5(*a*) indicates a state in which wiping is not yet started. At that time, the attached substance 70, such as ink droplets or dust particles, are present around the discharge ports 51*aa* of the discharge port surface 51*ab* of the ink jet recording head 51*a*. In this embodiment, the ink jet recording head 51*a* moves past the blade 60*a* from the right side to the left side as viewed in FIG. 5 while the blade 60*a* is stationary.

FIG. 5(*b*) shows a wiping operation halfway complete. At that time, the distal end of the blade 60*a* wipes the discharge port surface 51*ab*, whereby the ink droplets or dust particles on the discharge port surface 51*ab* are wiped off by the blade 60*a*.

FIG. 5(*c*) indicates a state in which wiping has been completed. At that time, the blade 60*a* carries the ink or dust which has been removed from the discharge port surface 51*ab* by the wiping operation.

FIG. 5(*d*) indicates a state in which the blade is retracted for cleaning by the absorbing cleaning device 60*e*.

Since the wiping operations up to FIG. 5(*c*) are performed by the relative movement between the blade 60*a* and the recording head 51*a*, it may also be arranged such that the blade 60*a* moves past the fixed recording head 51*a*.

Figures 6A, 6B, 6C, 6D:
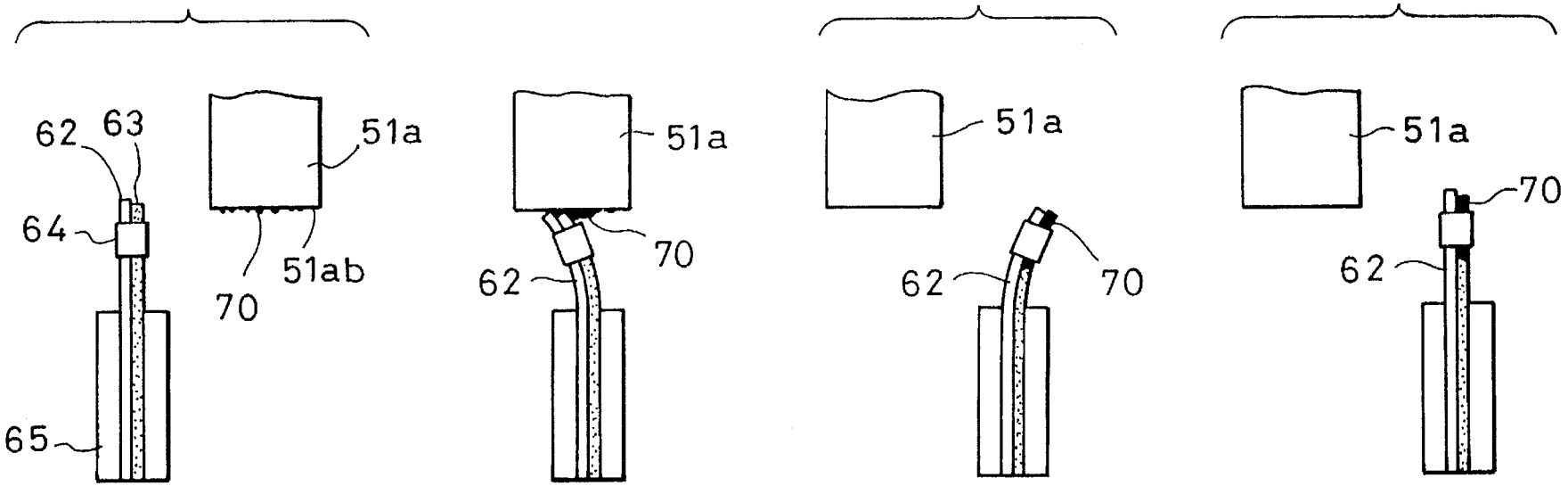
FIGS. 6$(a)$, 6$(b)$, 6$(c)$ and 6$(d)$ illustrate a cleaning operation performed by a cleaning blade according to another embodiment of the present invention.

FIGS. 6(*a*), 6(*b*), 6(*c*) and 6(*d*) are schematic views Showing another embodiment of a recovering mechanism in which the recording head of an ink jet printer is wiped by a blade.

In FIG. 6, reference numeral 51*a* denotes an ink jet recording head. Reference numeral 51*ab* denotes a discharge surface (a face) corresponding to a head front surface in which the discharge ports are formed in a predetermined array. Reference numeral 62 denotes a blade formed of an elastic material, such as rubber or soft plastic. Reference numeral 63 denotes a soft absorbing member made of, for example, sponge. The absorbing member 63 is supported by a fixing member 64 that prevents it from separating from the blade 62 but allows the blade 62 to slide against the member 63. Reference numeral 65 denotes a blade holder to which the blade 62 and the absorbing member 63 are fixed. Reference numeral 70 denotes ink droplets or dust particles attached to the discharge port surface 51*ab* of the ink jet recording head 51*a*.

Wiping of the discharge port surface 51*ab* is performed by scanning the discharge port surface 51*ab* with the blade 60*a* in the sequence FIGS. 6(*a*)→6(*b*)→6(*c*)→6(*d*). FIG. 6(*a*) shows a state in which wiping is not yet started. At that time, the attached substance 70, such as ink droplets or dust particles, are present around the discharge ports of the discharge port surface 51*ab* of the ink jet recording head 51*a*. In this embodiment, the blade 62 moves past the recording head 51a from the left side to the right side as viewed in FIG. 6 while the ink jet recording head 51*a* is at a stop.

FIG. 6(*b*) shows a wiping operation halfway complete. At that time, the blade 62 wipes the discharge port surface 51*ab*, whereby the ink droplets or dust particles on the discharge port surface 51*ab* are wiped off by the blade 62. At that time, the absorbing member 63 does not contact the discharge port surface 51*ab*, because the absorbing member is slightly shorter than the blade 62.

FIG. 6(*c*) indicates a state in which wiping has been completed. At that time, the blade 62 is bent in a direction opposite to that in which it is bent during wiping, because of the reaction when the blade drops off the surface 51*ab*, thus bringing the absorbing member 63 into contact with the blade 62 up to the distal end thereof. Consequently, the ink or dust attached to the blade 62 is absorbed by the ink absorbing member 33.

FIG. 6(*d*) indicates a state in which all the wiping operation has been completed. At that time, no foreign material is present on the blade 62.

Figure 7:
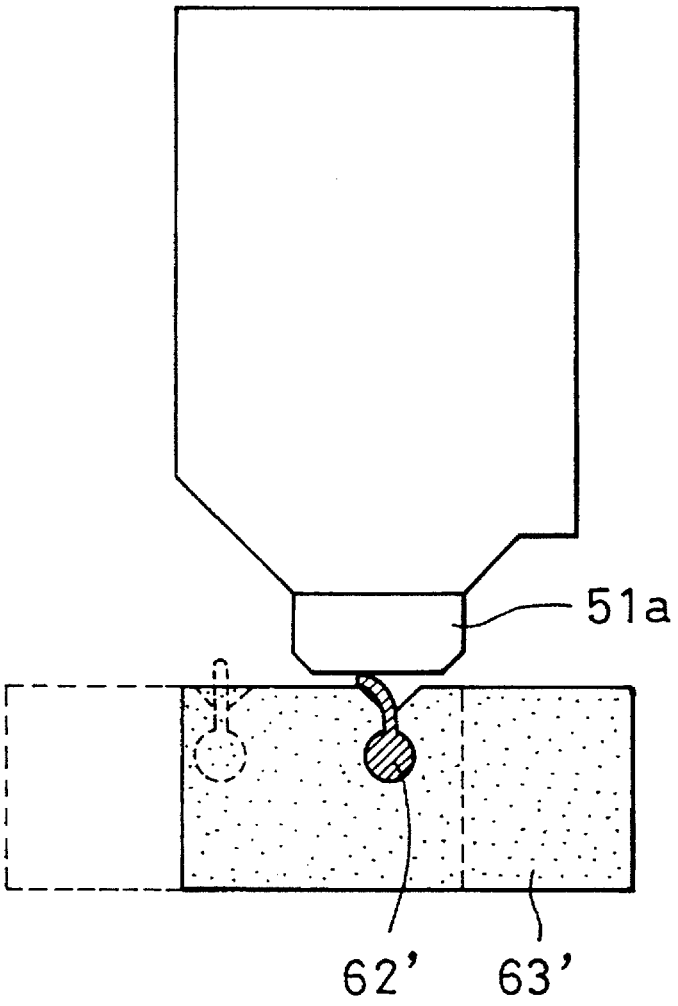
FIG. 7 illustrates a cleaning operation performed by a cleaning blade according to a still further embodiment of the present invention.

FIG. 7 shows another example of the wiping operation. Reference numeral 51*a* denotes a head. An elastic blade 62 is inserted into an ink absorbing cleaning device 63'. A groove into which the ink absorbing device 63' is inserted is bevelled so that it does not inhibit bending of the blade 62'. The groove has a shape in which the distal end portion of the blade 62' is brought into contact with part of the bevelled portion of the ink absorbing device 63' when the blade 62' wipes the head 51*a*.

As will be understood from the foregoing description, the ink jet printer according to the present invention has a blade that is wiped, so that printing failure and soiling of the interior of the apparatus with scattered ink do not occur. Further, since blade wiping is performed in one direction, when the blade is advanced or retracted, cleaning of the blade can be performed without requiring a complex mechanism.

Further, in an ink jet recording head of the type in which the discharge port surface is wiped by a blade, since the blade which has been used for wiping the discharge port surface is cleaned by the ink absorbing device placed in contact therewith, discharge failure of the discharge ports or scattering of the ink can be more readily eliminated.

Further, an arrangement whereby the distal end of the blade or the vicinity thereof makes contact with the ink absorbing member as a consequence of bending offers the following advantages:

(1) Since the ink on the blade soaks into the absorbing member during the head cleaning operation, scattering of the removed ink, which can occur when the blade drops abruptly off the head, can be eliminated.

(2) Since the removed ink can be absorbed along the blade, no ink remains on the blade, thus preventing ink from permanently adhering to the blade.

(3) Since an ink absorbing member at another location or at an extension of the stroke of the blade can be eliminated, the size of the apparatus can be reduced.

(4) Since a head cleaning and blade cleaning operation can be performed concurrently, cleaning time can be reduced.

What is claimed is:

1. A recovering mechanism for cleaning a discharge surface of an ink jet head mounted on a recording apparatus having a distance adjusting mechanism for adjusting a distance between a platen which supports a recording medium and said discharge surface in accordance with a kind of said recording medium, said ink jet head having discharge ports arrayed in an orthogonal direction relative to a moving direction of said ink jet head which crosses a feeding direction of said recording medium, said recovering mechanism comprising:

a cleaning blade for rubbing said discharge ports arrayed on said discharge surface and for cleaning said discharge surface;

an arm member connected with a portion of said cleaning blade and contacted with a portion of a carriage having said ink jet head;

a supporting member for supporting said cleaning blade and said arm member; and a connecting member for connecting said cleaning blade and said arm member with said supporting member at a portion of the opposite side of a contacting surface with said ink jet head and for enabling said cleaning blade to incline so as to match with an adjustment of a distance between said platen and said discharge surface at said connecting portion.

2. The recovering mechanism according to claim 1 wherein said arm member includes two arms.

3. The recovering mechanism according to claim 1, further comprising a cleaning device for removing material attached to a cleaning surface of said cleaning blade.

4. The recovering mechanism according to claim 3, wherein said cleaning device performs a series of operations to remove ink from said cleaning blade.

5. The recovering mechanism according to claim 3, wherein said cleaning device comprises a porous absorbent member for wiping said cleaning blade.

6. The recovering mechanism according to claim 5, wherein said cleaning device includes a slot through which said blade extends for contacting said discharge surface, said blade being movable relative to said cleaning device to wipe material from said blade.

7. The recovering mechanism according to claim 5, wherein said blade is of an elastic material and said cleaning device comprises a flat member lying along a side of said blade, said blade being deformed in one direction when contacting said discharge surface with a distal end of said side of said blade and being deformed in another direction upon leaving said discharge surface to cause said distal end of said blade at said side to contact said flat member.

8. The recovering mechanism according to claim 5, wherein said blade has an end rotatably embedded in said cleaning device.

9. An ink jet apparatus including an ink jet head having discharge ports arrayed in an orthogonal direction relative to a moving direction of said ink jet head which crosses a feeding direction of a recording medium, said apparatus comprising:

feeding means for feeding said recording medium;

an inclination adjusting mechanism for adjusting a distance between a platen which supports said recording medium and said discharge surface in accordance with a kind of recording medium; and a recovering mechanism for cleaning said discharge surface of said ink jet head, said recovering mechanism comprising a cleaning blade for rubbing said discharge ports arrayed on said discharge surface and for cleaning said discharge surface;

an arm member connected with a portion of said cleaning blade and contacted with a portion of a carriage having said ink jet head;

a supporting member for supporting said cleaning blade and said arm member; and a connecting member for connecting said cleaning blade and said arm member with said supporting member at a portion of the opposite side of a contacting surface with said ink jet head and for enabling said cleaning blade to incline so as to match with an adjustment of a distance between said platen and said discharge surface at said connecting portion.

10. The ink jet apparatus according to claim 9, wherein said inclination adjusting mechanism includes two arms.

11. The ink jet apparatus according to claim 9, wherein said recovering mechanism includes a cleaning device for removing material attached to a cleaning surface of said cleaning blade.

12. The ink jet apparatus according to claim 11, wherein said cleaning device performs a series of operations to remove ink from said cleaning blade.

* * * * *

UNITED STATES PATENT AND TRADEMARK OFFICE

CERTIFICATE OF CORRECTION

PATENT NO. : 5,606,354

DATED : February 25, 1997

INVENTOR(S) : TOSHIHIKO BEKKI, ET AL.

It is certified that error appears in the above-identified patent and that said Letters Patent is hereby corrected as shown below:

Title page,

[56] REFERENCES CITED

Foreign Patent Documents
"3246052" should read --3-246052--.
"4278358" should read --4-278358--.

COLUMN 1

Line 33, "discharge-recovery" should read --discharge recovery--.

COLUMN 2

Line 58, "example" should read --an example--.

COLUMN 5

Line 36, "Showing" should read --showing--.

UNITED STATES PATENT AND TRADEMARK OFFICE

CERTIFICATE OF CORRECTION

PATENT NO. : 5,606,354

DATED : February 25, 1997

INVENTOR(S) : TOSHIHIKO BEKKI, ET AL.

It is certified that error appears in the above-identified patent and that said Letters Patent is hereby corrected as shown below:

COLUMN 6

Line 13, "member 33." should read --member 63.--.

Signed and Sealed this

Twenty-first Day of October 1997

*Attest:*

BRUCE LEHMAN

*Attesting Officer*

*Commissioner of Patents and Trademarks*